US007601677B2

(12) United States Patent
Graiver et al.

(10) Patent No.: US 7,601,677 B2
(45) Date of Patent: Oct. 13, 2009

(54) TRIGLYCERIDE BASED LUBRICANT

(76) Inventors: Daniel Graiver, 2355 N. Perrine Rd., Midland, MI (US) 48640; Kenneth W. Farminer, 2712 Plymouth St., Midland, MI (US) 48642; Ramani Narayan, 4275 Conifer Cir., Midland, MI (US) 48864; Phuong T. Tran, 2485 Houghton Hollow Dr., Lansing, MI (US) 48911

( * ) Notice: Subject to any disclaimer, the term of this patent is extended or adjusted under 35 U.S.C. 154(b) by 805 days.

(21) Appl. No.: 10/915,749

(22) Filed: Aug. 11, 2004

(65) Prior Publication Data

US 2006/0035794 A1 Feb. 16, 2006

(51) Int. Cl.
*C10M 101/04* (2006.01)

(52) U.S. Cl. ..... 508/491

(58) Field of Classification Search ..... 508/139, 508/216, 246, 329, 336, 485, 486, 491, 496, 508/527, 550

See application file for complete search history.

(56) References Cited

U.S. PATENT DOCUMENTS

| | | | | |
|---|---|---|---|---|
| 5,151,205 | A | 9/1992 | Culpon, Jr. | |
| 5,378,249 | A | 1/1995 | Morrison | |
| 5,507,963 | A * | 4/1996 | Wolf | 508/258 |
| 5,562,867 | A | 10/1996 | Tiffany, III et al. | |
| 5,585,535 | A | 12/1996 | Fehr et al. | |
| 5,750,844 | A | 5/1998 | Fehr et al. | |
| 5,750,845 | A | 5/1998 | Fehr et al. | |
| 5,880,075 | A | 3/1999 | Hartley et al. | |
| 5,888,947 | A | 3/1999 | Lambert et al. | |
| 6,127,327 | A * | 10/2000 | Camenzind et al. | 508/567 |
| 6,380,139 | B1 * | 4/2002 | Zinke et al. | 508/426 |
| 6,806,235 | B1 * | 10/2004 | Mueller et al. | 507/138 |
| 2002/0119895 | A1 * | 8/2002 | Cook et al. | 508/186 |
| 2003/0186824 | A1 * | 10/2003 | Chiu et al. | 508/490 |
| 2004/0006792 | A1 | 1/2004 | Fillatti et al. | |
| 2004/0029749 | A1 * | 2/2004 | Legros et al. | 508/487 |
| 2004/0248746 | A1 * | 12/2004 | Matsui | 508/491 |

OTHER PUBLICATIONS

Cyberlipid Center, Fats and Oils; http://www.cyberlipid.org/glycer/glyc0064.htm#top.*

OilsbyNature Inc., Linseed Oil. http://www.oilsbynature.com/products/linseed-oil-refined.htm.*

Market Opportunity Summary, Soy-Based Lubricants, United Soybean Board, Jan. 2004.

* cited by examiner

*Primary Examiner*—Glenn A Caldarola
*Assistant Examiner*—Taiwo Oladapo
(74) *Attorney, Agent, or Firm*—Robert L. McKellar; McKellar IP Law, PLLC

(57) ABSTRACT

A method for lubrication by supplying a liquid lubricant to moving metal parts, more than fifty percent by weight of the liquid lubricant being a triglyceride vegetable oil having a saturated fatty acid content of less than nine percent by weight of the triglyceride vegetable oil and a polyunsaturated fatty acid content of more than seventy percent by weight of the triglyceride vegetable oil, the triglyceride vegetable oil having an American Petroleum Institute Thermo-Oxidation Engine Oil Simulation Test rod residue weight of less than thirty five milligrams and a pour point of less than minus twenty degrees Celsius.

10 Claims, No Drawings

TRIGLYCERIDE BASED LUBRICANT

BACKGROUND

The present invention relates to the use of environmentally friendly triglyceride vegetable oils as the base lubricant in, for example, internal combustion engine applications. The lubricant of the instant invention has utility in applications including passenger car motor oils, automatic transmissions fluids, gear oils, hydraulic fluids, chain bar lubricants, way lubricants for machinery operations, diesel lubricants, turbine lubricants, wire rope lubricants, metal cutting lubricants and tractor fluids. In addition to providing excellent lubricity with respect to petroleum-based lubricants the lubricants of the instant invention are also readily biodegradable. Biodegradability of an engine lubricant is particularly desirable in two cycle engines and other total loss applications, such as in chain oils and rail oils.

The principal use of motor oils is to prevent metal-to-metal contact between moving engine parts with respect to heat and friction. In the absence of a lubricant, friction caused by the rubbing of the moving parts creates heat, which then acts to weld tiny imperfections in the moving parts together. The welds then tear and re-weld themselves. This process, referred to as "scuffing", if allowed to continue, will cause engine failure.

Motor oils decrease friction and thus prevents the metal-to-metal contact by forming a film between moving parts. It further acts as a coolant between moving parts and helps to minimize corrosion as well as being a sealant for piston rings.

The requirements for oils used for total loss applications are quite similar to motor oils. The difference being that total loss oils are used and then are thereafter left or discarded in the proximate environment. Examples of total loss applications include rail oils for trains, bar/chain oils for woodcutting and metal cutting oils. Although the consumption of total loss oils is relatively small when compared to engine oils, the cumulative impact effect is dramatic. A train alone may consume 5 gallons of oil per 1,000 miles as the oil is sprayed on the track to lubricate the wheels. This amounts to a total of 300,000 gallons annually being discarded along railings within the U.S. alone.

In addition to preventing heat and friction, effective lubricants should resist viscosity change, retain their viscoelastic properties (particularly at low temperatures), resist thermal oxidation (particularly at high temperatures), protect against corrosion and rusting, provide wear protection, prevent foaming and resist the formation of sludge or deposits in service. They should also perform effectively at various lubrications regimes ranging from hydrodynamic thick film regimes to boundary thin film regimes.

The oxidation, thermal and hydrolytic stability characteristics of a lubricating oil helps predict how effectively an oil will maintain its lubricating properties over time and resist sludge formation. Lubricants containing double bonds are particularly sensitive to oxidation and are known to partially oxidize when contacted with oxygen at elevated temperatures for prolonged periods of time. The oxidation process produces acidic bodies within the lubricating oil, which are corrosive to metals. The oxidation products further lead to the formation of sludges that tend to clog valves, plug filters and eventually result in overall breakdown of the viscosity and lubricating characteristics of the lubricant. Ultimately, sludge formation can result in pluggage, complete loss of oil system flow and failure or damage to machinery.

Traditionally, mineral oils, produced from petroleum, have been the primary source of engine lubricants, as well as total loss application. The petroleum oils are composed primarily of hydrocarbons in nature and therefore lack chemical functionality. These petroleum oils are structurally composed of naphthenic, parafinic or aromatic structures. Naphthenic structures have the common, general characteristics of following: low viscosity, good pour points, and poor oxidative stability. Paraffinic structures also have common characteristics: they have higher viscosity, high pour points and good oxidative stability. Aromatic structures generally have very high viscosity, variable pour points and poor oxidative stability.

Petroleum based lubricants suffer from a number of drawbacks. The crude petroleum from which they are derived is a nonrenewable resource. Petroleum based motor oils can be highly toxic to the environment and can be hazardous to both the flora and fauna. Recent studies indicate these oils are carcinogenic and they are classified as a hazardous waste. Finally, petroleum based oils are not readily degraded in the environment. As a result, they persist for long periods in an ecosystem and are considered pollutants. The ecological problems associated with the refining and disposal of petroleum products are well known.

A second group of available lubricants are the synthetic oils. Synthetic oils have been developed to obtain intrinsic qualities such as lubricity and thermal stability. They are frequently designed for use in extreme conditions such as extreme temperature, vacuum, radiation or chemical environments. The most common synthetic lubricants are silicones, polyglycols, phosphate esters, dibasic acid esters and silicate esters. Synthetic lubricants are relatively costly and can also suffer from a multitude of drawbacks similar to those of petroleum. They are frequently toxic to the environment, hazardous to flora and fauna and are not readily biodegradable.

A third group of lubricating oils is known as fixed oil. These oils composed of fatty acids and alcohols, the radicals of which are joined to form fatty acid esters as in triglycerides. They are called fixed oils since they will not volatilize without decomposing. Vegetable oils are obtainable in large volumes from renewable resources and, in general, are readily biodegradable or "environmentally friendly". Thus, such oils and related polyol fatty acid ester stocks are potentially attractive for use in a wide variety of applications.

Unfortunately, vegetable oils, however, have not been often as general machine lubricants due to the fact that they do not possess the desired spectrum of characteristics relating to their pour point and oxidative stability. Since they contain substantial amounts of unsaturation (i.e., one or more carbon-carbon double bonds distributed along the fatty acid residue). Such unsaturation is associated with oxidative reactivity to render the oils insufficiently stable as an effective lubricant at elevated temperatures. If efforts are made to reduce the degree of unsaturation, for example by hydrogenation, generally undesirable changes in the pour point and/or viscosity index occur, which lead to solidification and unacceptable loss of the viscoelastic properties. These undesirable changes adversely affect the low service temperature of the lubricating oils.

Vegetable oils do however possess many desirable properties for use as a lubricant. In particular, vegetable oils typically provide good boundary lubrication, suitable viscosity, high viscosity index, low volatile fraction, and high flash point. In addition, vegetable oils are generally nontoxic and readily biodegradable. For example, under standard test conditions (e.g., OCED 301D test method), a typical vegetable oil can biodegrade up to 80% into carbon dioxide and water in 28 days, as compared to 25% or less for typical petroleum-based lubricating oil.

Consequently, there is, for example, a strong need for an effective motor oil which can lubricate moving metal parts in internal combustion engines, which motor oil is derived from a renewable resource, is non-toxic to the environment and is readily biodegradable. The oil should also be cost effective to produce and market. It should also be usable in other applications such as total loss applications.

Prior teachings in the application of vegetable oils for lubrication have been primarily focused on the use of these oils as additives to petroleum-base oil. Prior teachings have claimed the use of vegetable oils as additives in petroleum lubricants for engines and transmissions. The enhanced lubricity of such blends has significantly improved the efficacy of petroleum-based lubricants but they were rarely used at percentages exceeding 20 percent of the composition by volume of the final lubricant. Other applications primarily use a transesterified vegetable oil, converting the triglyceride to the free fatty acid form prior to use.

There are continuing demands for lubricant compositions suitable to operate at high temperature in excess of 250° C. Such lubricants must provide lubrication and anti-wear protection. In addition, they must be stable in the high temperature environment, or decompose harmlessly without forming hard, varnish-like deposits or unacceptable amounts of smoke. Many industrial processes involve operation of open chain and drive gear assemblies that are associated with ovens, furnaces, kilns and other hot equipment. Such chain and drive gear assemblies are used in the manufacture of textiles, wallboard, corrugated metal, paper and plastic film.

In addition to not forming deposits or varnish and possessing stability at high temperatures, the lubricants must perform under high load, be compatible with all materials in contact with the lubricant and be low in volatility. Existing commercial lubricants for chain and drive gear operations, which are based on vegetable oils or other glycerol-based esters and mineral oil, lack sufficient high-temperature stability. Polyolefins or polyacid esters also lack the necessary high-temperature stability. All these lubricants are prone to varnish formation and are characterized by relatively high volatility.

In industrial chain and drive gear assemblies operating in a static mode, spent lubricant collects and remains in pools under high temperature conditions. This causes the lubricants to form varnish-like deposits that are highly undesirable. Such deposits often lead to equipment failure, increased down time and higher maintenance costs. Varnish formation results primarily from thermal and oxidative degradation as well as by excessive evaporation.

One such high temperature chain and drive gear lubricant is described in U.S. Pat. No. 5,151,205 by Calpon, Jr. While the Calpon patent describes a wide variety of synthetic polyalphaolefin based oils and ester based oils, the described compositions include a polyalphaolefin base oil, an ester oil solubulizer and 2-4 wt. % of a polybutene tackifier. The composition is promoted for reducing smoking in chain and drive gear assemblies operated at high temperatures. However, such lubricants based on these polyalphaolefins tend to evaporate under high temperature exposure and are not fully satisfactory. Presently, no 100% polyol ester based chain lubricants are fully satisfactory in this respect.

Accordingly, it is highly desirable to provide high temperature lubricants suitable for use in high temperature chain oil environments that exhibit reduced evaporation rates under high temperature conditions and avoid the varnish/deposits shortcomings of the commercially available chain oil lubricants.

The use of synthetic "biodegradable" oils which, exhibit improved lubricity and anti-wear properties and are also claimed to satisfy environmental standards for aquatic toxicity is known in the prior art; U.S. Pat. No. 5,378,249 (1995) generally discloses biodegradable synthetic two-cycle engine oils, which is comprised of a mixture of 20-80% heavy ester having a viscosity of at least 7 cSt at 100° C. in combination with 10-85 wt. % of a light ester having a viscosity of less than 6 cSt at 100° C. Another patent WO94/05745 (1994) discloses mixed polyol esters of $C_{16}$-$C_{20}$ and $C_5$-$C_{10}$ carboxylic acids, and similarly, U.S. Pat. No. 5,562,867 (1996) discloses two-cycle oils based on $C_{13}$ oxo alcohol adipate and U.S. Pat. No. 5,880,075 (1999) by Hartley discloses esters of polyols with $C_{12}$-$C_{28}$ carboxylic acids as highly effective lubricity additives when combined with a base oil ester of an alcohol and a $C_5$-$C_{10}$ carboxylic acid. U.S. Pat. No. 5,888,947 (1999) to Lambert, discloses biodegradable lubricants suitable for internal combustion engines and total loss applications that are derived from Cruciferae, Leguminosae or Compositae and a vegetable oil additive principally derived from castor or lesquerella and the vegetable wax from jojoba or meadowfoam. Although, these lubricants are apparently effective, they are relatively costly as it is more desirable to have vegetable oil based lubricants based on common and plentiful crops such as soy.

Even though various lubricants based on both unmodified and modified vegetable oils have been developed and disclosed, there is a continuing need for a lubricant that retains the advantages of vegetable oils but with improved thermal and oxidative stability at high temperatures and a lower temperature pour point.

SUMMARY OF THE INVENTION

The instant invention provides a method for lubricating metal parts, such as a bearing or the piston and piston rings of an internal combustion engine, using a vegetable oil based lubricant having the excellent thermal and oxidative stability at high temperatures of a petroleum based lubricant as well as a relatively low pour point of a petroleum based lubricant. More specifically, the instant invention is a method for lubrication by supplying a liquid lubricant to moving metal parts, more than fifty percent by weight of the liquid lubricant being a triglyceride vegetable oil having a saturated fatty acid content of less than nine percent by weight of the triglyceride vegetable oil and a polyunsaturated fatty acid content of more than seventy percent by weight of the triglyceride vegetable oil, the triglyceride vegetable oil having an American Petroleum Institute Thermo-Oxidation Engine Oil Simulation Test rod residue weight of less than thirty five milligrams and a pour point of less than minus twenty degrees Celsius.

DETAILED DESCRIPTION OF THE INVENTION

The instant invention is a method for lubrication, comprising the step of supplying a liquid lubricant to the moving metal parts, more than fifty percent by weight of the liquid lubricant being a triglyceride vegetable oil having a saturated fatty acid content of less than nine percent by weight of the triglyceride vegetable oil and a polyunsaturated fatty acid content of more than seventy percent by weight of the triglyceride vegetable oil, the triglyceride vegetable oil having an American Petroleum Institute Thermo-Oxidation Engine Oil Simulation Test rod residue weight of less than thirty five milligrams and a pour point of less than minus twenty degrees Celsius.

The triglyceride vegetable oil of the instant invention is preferably a "low saturate" vegetable oil, preferably, low saturate soybean oil. However, it should be understood that many low saturate vegetable oils are not suitable for use in the instant invention. For example, the low saturate soybean oil of US patent application publication 20040006792 filed on Mar. 21, 2003 to Fillatti, J. J., Bringe, N.A, and Dehesh, K., does not contain sufficient polyunsaturated fatty acid. On the 5 other hand soybeans described in one or more of the following US Patents produce oil that is highly preferred in the instant invention: 5,585,535; 5,750,844; and 5,750,845. Oil from LoSatSoy® (Iowa State University Research Foundation) produce a highly preferred vegetable oil in the instant invention. LowSatOil® brand low saturate soybean oil from Zeeland Farm Services, is a highly preferred vegetable oil in the instant invention.

Approximately 11,000 acres of LoSatSoy trade marked soybeans were grown under contract with Zeeland Farm Services in 2003. The low saturate oil from these beans was obtained by conventional oil extractions methods. The following table is a comparison of the major fatty acid components of conventional soybean oil, the Zeeland LowSatOil and a typical low saturated oil of US patent application publication 20040006792 (the '792 oil).

| | Soybean Oil | Zeeland LowSatOil | '792 Oil |
|---|---|---|---|
| Saturated Fatty Acid (Palmitic and Stearic) | 14% | 7% | 6% |
| Monounsaturated Fatty Acid (Oleic) | 23% | 20% | 70% |
| Polyunsaturated Fatty Acid (Linoleic and Linolenic) | 60% | 70% | 24% |

Tests of the Zeeland Farm Services LowSatOil oil indicate significant improvement in the thermal and oxidation resistance as well as performing well in other tests. Several test methods are used:

Method 1: The American Petroleum Institute's Thermo-oxidation

Engine Oil Simulation Test (TEOST) for moderately high temperature deposit conditions in the piston ring zone of modern smaller, highly stressed engines. This test is run for 10 hours at 285° C. with 8.5 grams of oil and catalyst recirculated continuously over a special steel rod heated at the same temperature. Air is circulated continuously over the rod to increase exposure to oxygen. In addition, any volatile material is caught by the walls of a surrounding mantle and collected separately thus increasing the stress on the remaining oil. Weight of the rod before and after the test is the main criterion.

The Zeeland LowSatOil has a rod residue weight of 7.6 milligrams in the TEOST test. Conventional soybean oil has a rod residue weight of 586 milligrams in the TEOST test. The specification for an engine oil meeting the American Petroleum Institute GF-4 specification is a rod residue weight of less than 35 milligrams in the TEOST test.

The TEOST test results for the vegetable oil of the instant invention is a surprise. The January 2004 United Soybean Board Market Opportunity Summary for Soy-Based Lubricants states that oil from genetically modified or nontransgenic soybeans for use as a crankcase oil should contain increased oleic acid and decreased linolenic acid relative to conventional soybean oil since oleic acid is known to have better oxidation stability while linolenic acid is known to have poor oxidation stability.

Method 3: Pour Point Test

The Scanning Brookfield Technique (SBT) continuously measures the viscosity and tendency to build structure over a chosen range of low temperatures by decreasing the temperature slowly (1° C./hr). Structure causes an increase in viscosity above the exponential relationship expected from a Newtonian fluid which is, by definition, free of gel-forming tendencies. The presence of the structure is found by taking the derivative of the viscosity-temperature curve from 0° C. to the lowest possible temperature for the viscosity limitations of the viscometer head.

The results show unusually good viscosity-temperature behavior of the Zeeland LowSatOil soy oil where the gelation temperature is lower than −30° C. and gelation index of 70.4, which is significantly better than gelation temperature of −7.2° C. and gelation index of 113 for conventional soy oil. The performance of the vegetable oil of the instant invention is comparable to conventional mineral oil lubricants.

Method 4: Falex Pin and V-block Test.

Two V-blocks press against a rotating pin from opposite side, 'pinching' the pin between them with a force that is progressively increased in steps by the test operator. The contact between the V-blocks and the pin are four straight lines and permit evaluation of the lubricant tested in the so-called quasihydrodynamic region of lubrication. This region can produce wear and ultimate seizure of the contiguous contacting surfaces. The test is conducted with increasing 50 lb steps of force with five minutes residence at each step. Wear, friction and pin temperature are measured at each step. As the load is advanced by use of a ratchet wheel with number teeth, some wear normally occurs on the pin and V-blocks. Normally, there is a higher level of wear at the beginning of test as the surfaces of the V-blocks and pin mate with each other. Similarly, as the loads applied begin to approach failure, wear increases. Since the loads applied also very slightly deform the contacting surfaces, it is desirable to distinguish wear from deformation.

After 5 minutes at a given load, the load applied is backed off to the initial starting load and the number of ratchet teeth required to obtain the initial load of 200# is obtained. The difference between this value and the previous value is related directly to the wear that has occurred under the given test load.

Step wear and cumulative wear during the tests are measured and the data indicates that the initial rate of wear from the cumulative wear is less for the Zeeland LowSatOil v. conventional soybean oil.

Method 5: Coefficient of Friction Test

In addition to wear, the Coefficient of Friction (COF) is considered a critical property of a lubricant. In general, vegetable oils have considerably better frictional properties than mineral oils. The Savant-modified Falex Pin and V-block test permits characterization of the frictional properties of the oils tested. The results for the vegetable oil of the instant invention show the expected low values of COF of about 0.004.

CONCLUSION

In conclusion, it is readily apparent that although the invention has been described above in relation with its preferred embodiments, it should be understood that the instant invention is not limited thereby but is intended to cover all alternatives, modifications and equivalents that are included within the scope of the invention as defined by the following claims.

What is claimed is:

1. A method for lubrication, comprising the step of supplying a liquid lubricant into contact with moving metal parts, more than fifty percent by weight of the liquid lubricant being a triglyceride vegetable oil having a saturated fatty acid content of less than nine percent by weight of the triglyceride vegetable oil and a polyunsaturated fatty acid content having an iodine value of from 140 to 160, the triglyceride vegetable oil having an American Petroleum Institute Thermo-Oxidation Engine Oil Simulation Test rod residue weight of less than thirty five milligrams and a pour point of less than minus twenty degrees Celsius.

2. The method of claim 1, wherein more than fifty percent by weight of the saturated fatty acid content of the triglyceride vegetable oil consists of palmitic and stearic acids, wherein more than fifty percent by weight of the polyunsaturated fatty acid content of the triglyceride vegetable oil consists of linoleic and linolenic acids, and wherein the triglyceride vegetable oil has a monounsaturated fatty acid content consisting of more than fifty percent oleic acid by weight of the monounsaturated fatty acid content of the triglyceride vegetable oil.

3. The method of claim 1, wherein at least ninety percent by weight of the fatty acids of the triglyceride vegetable oil contain from 16 to 26 carbon atoms.

4. The method of claim 1, wherein the liquid lubricant has pour point less than minus thirty degrees Celsius.

5. The method of claim 1, wherein the liquid lubricant contains an additive selected from the group consisting of: (a) water in combination with 0.1% to 15% anionic, emulsifier; (b) an oxidation inhibitor, Cc) an antiwear agent, (d) an antifoam agent, (e) a corrosion inhibitor, (f) a dispersant, (g) a viscosity index improver, (h) a pour point depressant, (i) a seal conditioner, (j) a metal deactivator, (k) a friction modifier, (l) a detergent (m) a mineral oil, (n) a synthetic ester oil, (o) a polyalkyleneglycol adduct oil, (p) synthetic oil, and mixtures of (a) to (p).

6. The method of claim 1, wherein the moving metal parts are contained in a two cycle Otto engine.

7. The method of claim 1, wherein the moving metal parts are contained in a two cycle diesel engine.

8. The method of claim 1, wherein the moving metal parts are contained in a four cycle Otto engine.

9. The method of claim 1, wherein the moving metal parts are contained in a four cycle diesel engine.

10. The method of claim 1, wherein the moving metal parts are contained in a turbine engine.

* * * * *